US008235641B2

(12) United States Patent
Delfer et al.

(10) Patent No.: US 8,235,641 B2
(45) Date of Patent: Aug. 7, 2012

(54) HINGED AND BIFURCATED CART DOCUMENT HANDLING APPARATUS UTILIZED WITH A LAZY-PORTRAIT DOCUMENT PRINTING SYSTEM

(75) Inventors: Frank W. Delfer, Granite Bay, CA (US); Charles B. Clupper, El Dorado Hills, CA (US); Marc J. Fagan, Folsom, CA (US); Brett Jay Flickner, Folsom, CA (US); Matthew Thomas Leettola, El Dorado Hills, CA (US)

(73) Assignee: DST Output, El Dorado Hills, CA (US)

( * ) Notice: Subject to any disclaimer, the term of this patent is extended or adjusted under 35 U.S.C. 154(b) by 1010 days.

(21) Appl. No.: 12/037,790

(22) Filed: Feb. 26, 2008

(65) Prior Publication Data

US 2008/0219813 A1 Sep. 11, 2008

Related U.S. Application Data

(63) Continuation-in-part of application No. 11/708,782, filed on Feb. 21, 2007, which is a continuation-in-part of application No. 11/492,594, filed on Jul. 25, 2006.

(60) Provisional application No. 60/904,256, filed on Feb. 28, 2007.

(51) Int. Cl.
*B65H 1/00* (2006.01)

(52) U.S. Cl. ..... 414/222.13; 414/223.02; 414/349; 280/47.17; 280/47.2

(58) Field of Classification Search ..... 280/47.17, 280/47.2, 47.24, 47.27, 47.28; 414/222.13, 414/223.02, 349, 350, 493, 598, 608, 641
See application file for complete search history.

(56) References Cited

U.S. PATENT DOCUMENTS

| | | | | |
|---|---|---|---|---|
| 4,307,958 | A | 12/1981 | McIrvine | |
| 4,928,252 | A | 5/1990 | Gabbe et al. | |
| 5,104,245 | A | 4/1992 | Oguri et al. | |
| 5,704,625 | A * | 1/1998 | Presnell et al. | 280/79.2 |
| 5,825,996 | A | 10/1998 | Davis et al. | |
| 5,887,126 | A | 3/1999 | Fujimoto | |
| 5,995,721 | A | 11/1999 | Rourke et al. | |
| 6,050,191 | A | 4/2000 | Enderle et al. | |
| 6,092,761 | A | 7/2000 | Mushaben | |
| 6,222,635 | B1 | 4/2001 | Gotoh | |
| 6,313,822 | B1 | 11/2001 | McKay | |

(Continued)

FOREIGN PATENT DOCUMENTS

EP 1174327 A3 1/2002

(Continued)

*Primary Examiner* — Saul Rodriguez
*Assistant Examiner* — Willie Berry, Jr.
(74) *Attorney, Agent, or Firm* — James M. Ritchey

(57) ABSTRACT

For use with lazy-portrait narrow-end to narrow-end (LPEE) formatted document pages printed on a continuous web of material, an apparatus and method of use for assembling correctly page-sequenced document sets that utilizes a slitter for separating the LPEE formatted document pages into two separate streams of continuous sheets that are loaded onto a document transfer cart that has two side-by-side and hinged-together document receiving trays, for each tray a removable bottom support plate assembly having casters on the lower portion of one of the bottom support plates, a top document delivery roller for each tray, a central hinge connecting the two trays to each another, support rack pivot rods, a handle secured to each tray, and cart transfer wheels.

20 Claims, 11 Drawing Sheets

U.S. PATENT DOCUMENTS

| | | | | |
|---|---|---|---|---|
| 6,337,745 | B1 | 1/2002 | Aiello, Jr. et al. | |
| 6,417,931 | B2 | 7/2002 | Mori et al. | |
| 6,507,411 | B1 | 1/2003 | Nishikawa et al. | |
| 6,509,977 | B1 | 1/2003 | Kujirai et al. | |
| 6,559,971 | B1 | 5/2003 | Watts et al. | |
| 6,595,465 | B2 | 7/2003 | Lamothe | |
| 6,705,702 | B2 | 3/2004 | Gunther et al. | |
| 6,813,038 | B1 | 11/2004 | Kadowaki | |
| 6,994,005 | B2 | 2/2006 | Lamothe | |
| 7,014,182 | B2 | 3/2006 | Marsh | |
| 2005/0238468 | A1 * | 10/2005 | Middleby | 414/490 |

FOREIGN PATENT DOCUMENTS

| | | | |
|---|---|---|---|
| EP | 1524169 | A1 | 4/2005 |
| JP | 08-179576 | A | 7/1996 |
| JP | 2000-141793 | A | 5/2000 |
| JP | 2000-229751 | A | 8/2000 |
| JP | 2003-011452 | A | 1/2003 |
| JP | 2005-297952 | A | 10/2005 |
| JP | 2005-320104 | A | 11/2005 |
| JP | 2006-273158 | A | 10/2006 |

* cited by examiner

HINGED AND BIFURCATED CART DOCUMENT HANDLING APPARATUS UTILIZED WITH A LAZY-PORTRAIT DOCUMENT PRINTING SYSTEM

CROSS-REFERENCE TO RELATED APPLICATIONS

This application is a continuation-in-part of copending application Ser. No. 11/708,782 filed on Feb. 21, 2007, incorporated herein by reference in its entirety, which is a continuation-in-part of copending application Ser. No. 11/492,594 filed on Jul. 25, 2006, incorporated herein by reference in its entirety. This application claims priority from U.S. provisional application Ser. No. 60/904,256 filed on Feb. 28, 2007, incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to an apparatus and method for handling lazy-portrait printed documents (printing across the continuous paper web to produce paired portrait orientated pages or in "lazy-portrait narrow-end to narrow-end" formatting (LPEE)) so as to generate acceptably oriented pages that are then processed and grouped into predesignated document sets with continuously numbered pages. More particularly, to a hinged divided or bifurcated transfer cart that permits a desired reorientation of a portion of the lazy-portrait printed documents to facilitate further processing in a correctly ordered page-sequence for document sets, wherein when LPEE head-to-head or bottom-to-bottom paired pages are printed, one half of the printed pairs must be flipped for generation of a sequential page count in each final assembled document set.

2. Description of Related Art

To fully understand the subject invention, it is deemed worthwhile to stress the difference between existing/traditional "two-up portrait" versus the current and novel subject "lazy-portrait" printing styles and the documents produced by each type of printing scheme. Existing high-speed duplex variable data printing is carried out most frequently with continuous form printers using what is termed a "two-up portrait" format on a continuous web of paper. Two portrait printed sheets are printed side-by-side (both oriented in the same exact direction. This process, the standard in the industry, produces a continuous output of pages where, for example, the first four sheets (eight pages, front and back on four, eventually separate, sheets) appear as shown in FIG. 1. Currently, an advantage of printing in the prior art format is that it is compatible with more existing printers and more existing post-printing equipment for handling the printed sheets. A critical element of the prior art printing method is that to print either black or color markings on both pages, with the headings in color and the body in black, both the black and color-capable printing heads must span the entire width (long-side to long-side of a page) of both the duplexed sheets, $W^B$ and $W^C$, respectively (see FIG. 1). FIG. 2 depicts a pair of traditionally formatted pages that are then separated/cut-apart and simply stacked on top of one another, as shown in FIG. 3, to produce a correctly page-sequences document set. Examples of printers that function in this manner are the IBM InfoPrint 4000 and Oce VarioStream 7000. In a typical prior art printing system a continuous stream of traditionally printed sheets (such as the ones shown in FIG. 1 and/or FIG. 2) is printed and then moves into a slitter that separates the single steam into two streams of continuous sheets that then enter a cutter and collator for further processing to generate correctly page-sequenced document sets (as illustrated in FIG. 3 for two cut sheets).

For the current subject invention, paper is printed in a lazy-portrait narrow-end to narrow-end (LPEE) format (as seen in FIGS. 4 and 5, for four pages and two pages, respectively), which is a means for more efficient and cost effective printing of variable and form data onto paper oriented in a lazy-portrait orientation. The term "lazy-portrait" (also known in the industry as "rotated landscape" when a printer merely uses a traditional printer head alignment spanning the entire page to print a rotated image) is defined as a portrait oriented page that is generated by printing the page from one wide edge to the other wide edge (side to side) and not from narrow edge or end to narrow edge or end (top to bottom or visa-versa), as is done in every other currently existing printing system.

The critically issue with the subject invention is that when a pair of head-to-head or bottom-to-bottom pages are printed on a continuous stream of paper, the single stream of paper with the paired images must then be separated/slitted into two separate streams of paper with one stream being flipped over to correctly orient the final pages when cut and stacked into a document set (as seen in FIG. 6 for a pair of LPEE printed sheets). The current subject invention presents a system and method for accomplishing this sheet flipping process by flipping one entire stream of post-slitted sheets via utilization of a hinged and bifurcated LPEE document transfer cart.

Again, it is noted that conventional paper transport cart systems and paper handling systems exist that can transport and process paper printed in the existing and traditional two-up portrait style (not the subject paper LPEE orientation). Future document sets have pages that are already aligned head to head, and existing finishing, cutting, and inserting equipment readily handles the orientation of the two-up portrait printed paper by slitting the two-up portrait web of paper in either first to last (1 to N) or last to first (N to 1) document page-sequencing.

Since the two-up portrait printed paper is printed narrow-end to narrow-end, there is a need to rotate/flip the stack of finished paper pages so that the document heads from both stacks (the slit stacks) of documents need to be ultimately presented and accumulated together to form a finished document set.

Various turn-bars are found on cutters for folded continuous form stacks or continuous form rolls, but the entire stream of paper is always reoriented by use of such turn-bars, completely unacceptable for the subject system/method in which only one half of the initial paper stream is required to be flipped. Prior inserters handle stacks of paper that are in printed two-up portrait format with either the head of the document or the bottom of the document printed first, in either first to last sequence order, or last to first sequence order.

An example of a currently manufactured cart for handling two up portrait paper is manufactured by Beste Bunch Co., Inc. This cart (very much a traditional dolly for moving heavy items from one location to another) is designed to receive paper coming out of a folder attached to a continuous form printer like an Oce VarioStream 7000. The existing prior art process is depicted clearly in FIGS. 7A, 7B, and 7C, In FIG. 7A a traditional dolly/cart is pivoted into a horizontal position on a support rack (on the far left of FIG. 7A) to accept incoming fan-folded documents. Such fan-folded documents are shown stacked on the dolly/cart (with a bottom support plate removed to accept incoming documents), extending along the delivery tract, and coming out of the printer (on the far right of FIG. 7A). As indicated, to permit the fan-folded documents to enter onto the dolly/cart from the delivery tract, the bottom support plate is temporarily removed, the fan-folded documents loaded, and the bottom support plate reinstalled when the documents are loaded. When the traditional dolly/cart is fully loaded with two-up portrait printed sheets the bottom support plate is secured back into a normal vertical load-supporting position and the entire dolly/cart pivoted on the support rack into the vertical transfer position with the wheels contacting the floor (plainly illustrated in FIG. 7B). As seen in FIG. 7C, the loaded traditional dolly/cart is then backed away from the support rack and moved to any desired location for transfer of the fan-folded documents. The entire intact (non-slitted) stream of two-up portrait printed sheets is moved as a continuous fan-folded unit.

The prior system is an easy way to process paper on a printer, folder, cart, and cutter, either a stand-alone cutter, or a cutter attached to a mail piece inserter.

The prior dolly/cart system must simply handle a stack of two-up portrait printed paper without any special handling or stack manipulation required, since the needed document orientation automatically results from the way the printed paper exits the printer. The paper is then pulled off of the prior art dolly/cart-stack in one direction into a page cutter, either first on-first off the cart, or first on-last off the cart, depending on how the cart was loaded with the paper.

U.S. Pat. No. 6,994,005 (an apparatus for slitting, merging, and cutting a continuous paper web) describes an in-line turn-bar that is positioned after slitting and prior to merging the two streams, but this invention only positionally moves one slit lane of paper to overlap with another slit lane of paper, without turning over the obverse to reverse orientation (or face to back orientation). This patent differs from the subject invention in that, since there is no need, suggestion, or teaching to so, it does not turn over the paper orientation.

U.S. Pat. No. 6,595,465 (a turn-bar assembly for redirecting a continuous paper web) describes turning a single web of paper to reorient the travel direction and, in addition, to optionally flip the paper web from obverse to reverse (face up to face down) image orientation in this reoriented travel direction. This patent differs from the subject invention in that it reorients the paper direction, which is not associated with the manner in which a turn-bar is employed in the subject invention.

BRIEF SUMMARY OF THE INVENTION

An object of the present invention is to provide a paper handling system that orients lazy-portrait narrow-end to narrow-end format printed sheets into correctly page-sequenced document sets.

Another object of the present invention is to furnish a paper handling apparatus and method that flips one of two paired lazy-portrait narrow-end to narrow-end format printed sheets to generate printed sheets that have correctly sequenced pages that are assembled into desired document sets.

A further object of the present invention is to supply a paper handling apparatus and method that produces correctly page-sequenced document sets from a continuous web of lazy-portrait narrow-end to narrow-end (LPEE) format printed sheets by slitting a continuous stream of LPEE paired sheets into two streams, flipping one of the two streams, cutting each stream, and collating the cut sheets into correctly page-sequenced document sets.

Still another object of the present invention is to disclose paper handling apparatus and method that produces correctly page-sequenced document sets from a continuous web of lazy-portrait narrow-end to narrow-end (LPEE) format printed sheets by slitting a continuous stream of LPEE paired sheets into two streams, loading each stream of slitted LPEE sheets into side-by-side receiving trays in the subject hinged and bifurcated cart, flipping one of the two streams by swinging the receiving trays into a back-to-back orientation, drawing off in the same direction from each of the receiving trays the two continuous streams of sheets, thereby flipping the orientation of one stream relative to the other, cutting each stream, and collating the cut sheets into correctly page-sequenced document sets.

Yet a further object of the present invention is to describe a document transfer cart comprising two hinged-together document receiving trays, a removable bottom support plate assembly for each tray, a top delivery roller for each tray, a hinge connecting the two trays to each another, support rack pivot means, handle means, and transport means.

Still yet another object of the present invention is to relate a document transfer cart, and method of use, comprising two side-by-side and hinged-together document receiving trays, for each tray a removable bottom support plate assembly having hinge rotational support means, a top delivery roller for each tray, a central hinge connecting the two trays to each another, support rack pivot means, handle means, and transport means.

Disclosed is an apparatus and method for correctly page-sequencing individual sheets initially printed on a continuous web of paper in a lazy-portrait narrow-end to narrow-end (LPEE) format. In LPEE format, when a pair of head-to-head or bottom-to-bottom pages are printed on a continuous stream of paper, the single stream of paper with the paired images must then be separated/slitted into two separate streams of paper with one stream being flipped over to correctly orient the final pages (to produce the correct page-sequences) when cut and stacked into a document set. The current subject invention presents an apparatus and method for accomplishing this sheet flipping process for one of the two paired document streams. The printed continuous web is split into two continuous streams of sheets by a slitter. One of the two continuous streams of sheets is then flipped by first loading both streams into the subject hinged and bifurcated cart. The subject cart comprises two hinged-together document receiving trays, a removable bottom support plate assembly for each tray (only one of which has a hinge rotational support means), a top delivery roller for each tray, a hinge connecting the two trays to each another, support rack pivot means, handle means, and transport means.

Further objects and aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIGS. 4-6 and FIGS. 8-15. It will be appreciated that the apparatus may vary as to configuration and as to details of the parts, and that the method of its use may vary as to the specific steps and sequence, without departing from the basic concepts as disclosed herein.

The hinged and bifurcated cart system invented for handling the lazy-portrait narrow-end to narrow-end (LPEE) format printed stacks of documents is extremely innovative in that it receives the stream of document pages (actually two paired and fan-folded streams of LPEE printed sheets that are split by a slitter apparatus) from a folder either N to 1 or 1 to N document sequencing and then passes on the sheets to further post-printing equipment (normally a cutter/collator) in a dramatically different page orientation that is possible from a traditional cart that delivers a single stream of fan-folded sheets to a cutter/collator.

Figure 14:
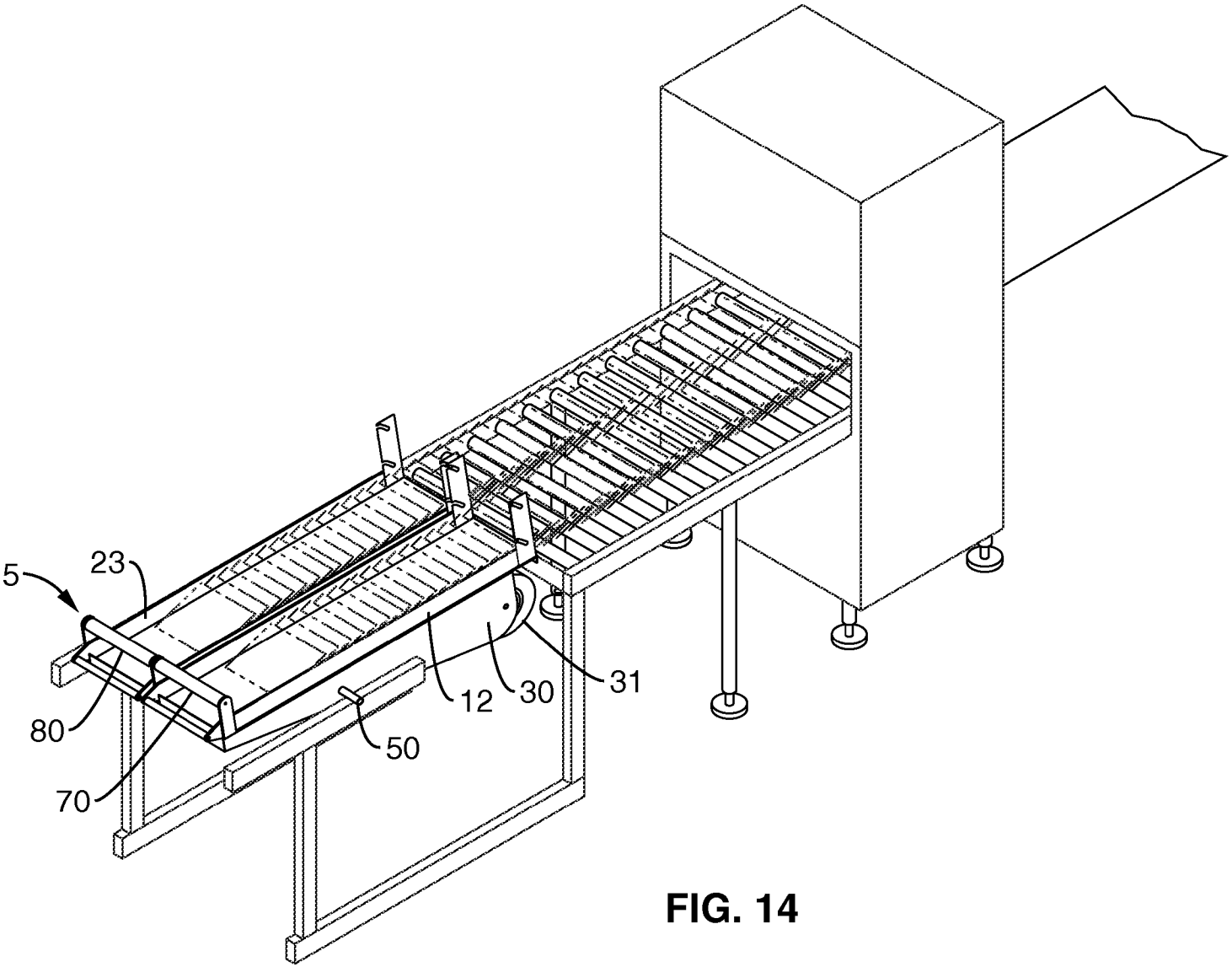
FIG. 14 show the subject invention in its closed state in a horizontal document loading position (pivoted up on a support rack) receiving two streams of fan-folded documents (one into each of the two hinged-to-each-other receiving trays) from a slitter that cut the LPEE single stream of sheet into two side-by-side streams.

The side-by-side and hinged-to-one-another receiving trays of the subject cart pivot together into an approximately horizontal receiving position on a receiving rack/frame (as seen in FIG. 14) for receiving or loading the split/slitted stream of fan-folded sheets that comes out of the slitter. The paper is stacked on the subject cart in a configuration similar to traditional two-up portrait printing, however, the critical and novel feature of the subject invention is that the printed pages are slit into two discrete fan-folded stacks that are then placed into the approximately horizontally positioned receiving tray areas of the subject invention (again, see FIG. 14). The subject cart is constructed to permit the side-by-side receiving trays to be pivoted into the approximately horizontal position for receiving the two folded streams of document fan-folded sheets. The receiving trays of the subject cart are then tipped/pivoted into an approximately upright orientation for transportation and handling.

Figure 15:
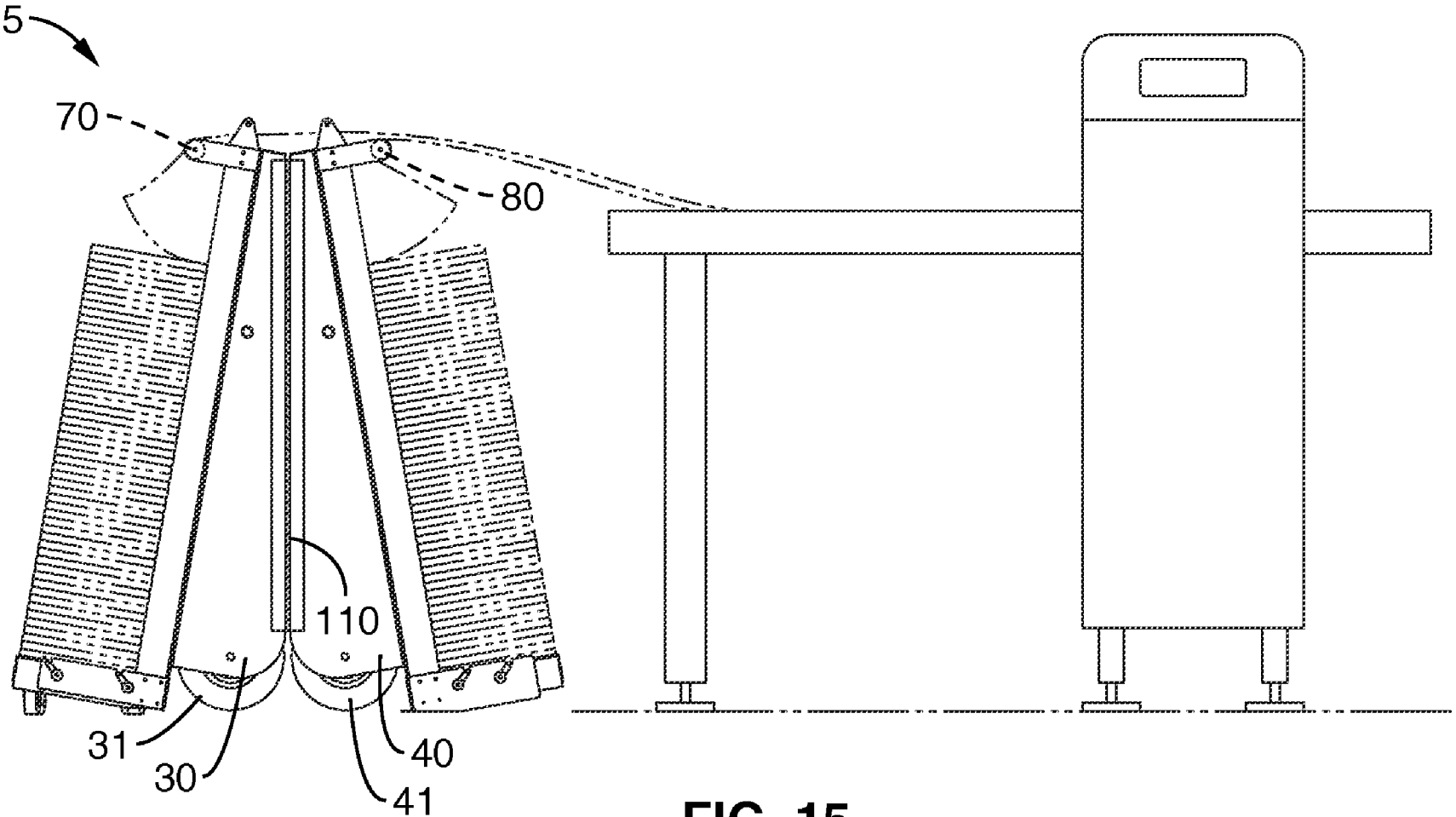
FIG. 15 shows the opened subject invention hinged and bifurcated cart loaded with two stacks of fan-folded LPEE documents that are being fed to a cutter/collator for further processing.

When the two stacks of fan-folded sheets are ready to be passed on the a cutter and collator, the two loaded receiving trays of the subject cart are then rotated 180° along a central hinge mechanism to reorient the alignment of the LPEE printed pages to one another. FIGS. 11-13 and 15 illustrate the results of the 180° rotation. This rotation results in flipping one steam of fan-folded documents, relative to the other stream, as the sheets are drawn off and into the cutter/collator. Thus, after cut and collated each page orientation of the original LPEE printed pages is now properly aligned so that the head and foot of each page is aligned in the same orientation and in proper page-sequential order. Again, please note that the obverse and reverse (face up and face down) image orientation generated by the LPEE format printing technique, such that one half of the original stack is printed in reverse image orientation (face down), whereas the other half of the stack is printed in obverse (face up) image orientation. Since one stack is rotated 180 degrees relative to the other, the final step to reorient the printed sheets is to pull the stream of sheets from both stacks (in the open cart orientation as seen in FIG. 15) in the same direction, thereby flipping one stack's sheets over, so that the reverse oriented stack is now re-oriented in obverse direction.

Figure 2:
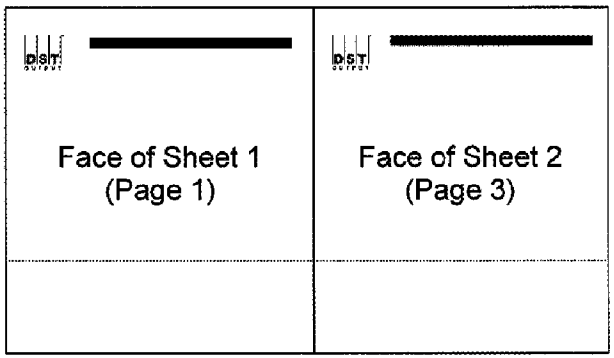
FIG. 2 (Prior Art)
FIG. 2 is a depiction representing the PRIOR ART, wherein two total sheets (still physically connected together) are shown with paired/duplexed-document pages printed side-by-side, with all side-by-side pages oriented in traditional portrait-parallel fashion to one another.
Figure 3:
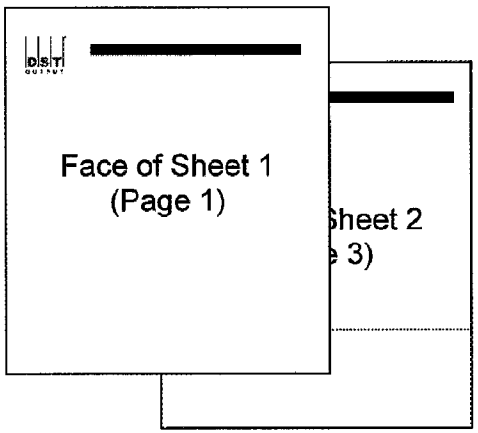
FIG. 3 (Prior Art)
FIG. 3 is a depiction representing the PRIOR ART, wherein two total sheets are shown (printed as traditional side-by-side paired/duplexed-document pages, with all side-by-side pages oriented in the traditional portrait-parallel fashion to one another) separated and directly stacked on top of one another to generate a correctly page-sequenced document.
Figure 1:
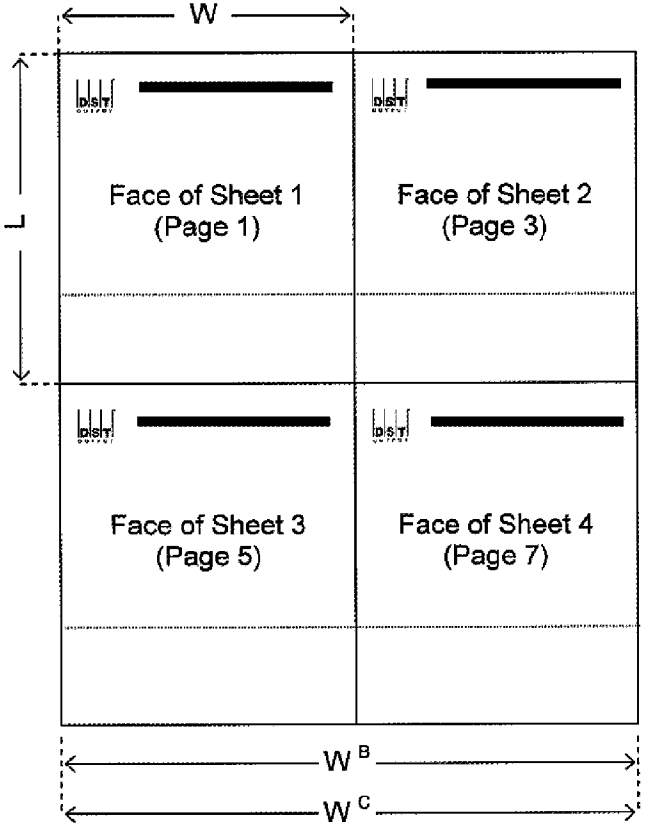
FIG. 1 (Prior Art)
FIG. 1 is a depiction representing the PRIOR ART, wherein four total sheets are shown with paired/duplexed-document pages printed side-by-side, with all side-by-side pages oriented in traditional portrait-parallel fashion to one another.
Figure 5:
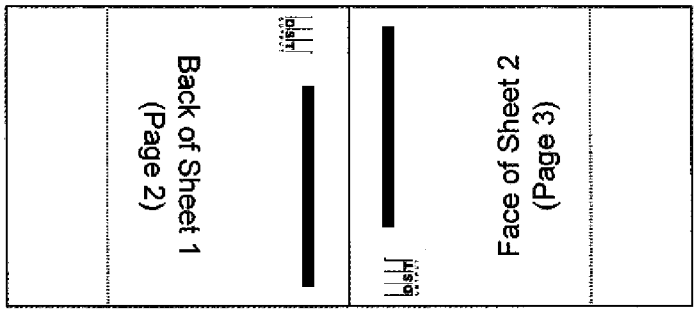
FIG. 5 shows the subject invention's formatting technique that produces lazy-portrait documents wherein a pair of printed sheets is depicted in a duplexed lazy-portrait head-to-head page orientation and printed on a continuous web in two printing lanes.
Figure 6:
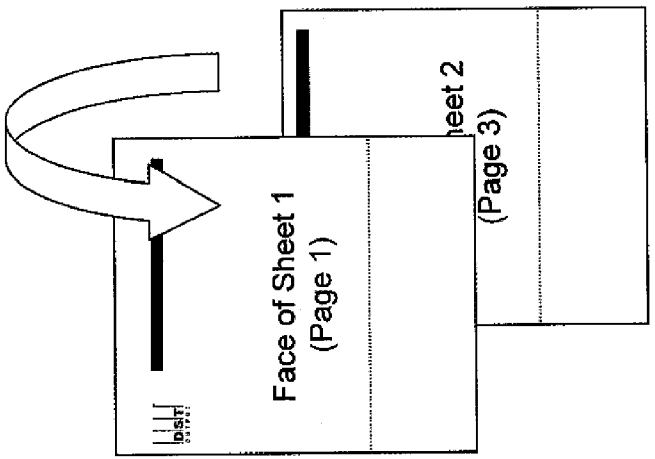
FIG. 6 shows the subject invention's ability to flip one of the paired sheets seen in FIG. 5 to produce correctly page-sequenced sheets (during normal operation, an entire stream of sheets are flipped and matched with its appropriate mate from the original pairing).
Figure 4:
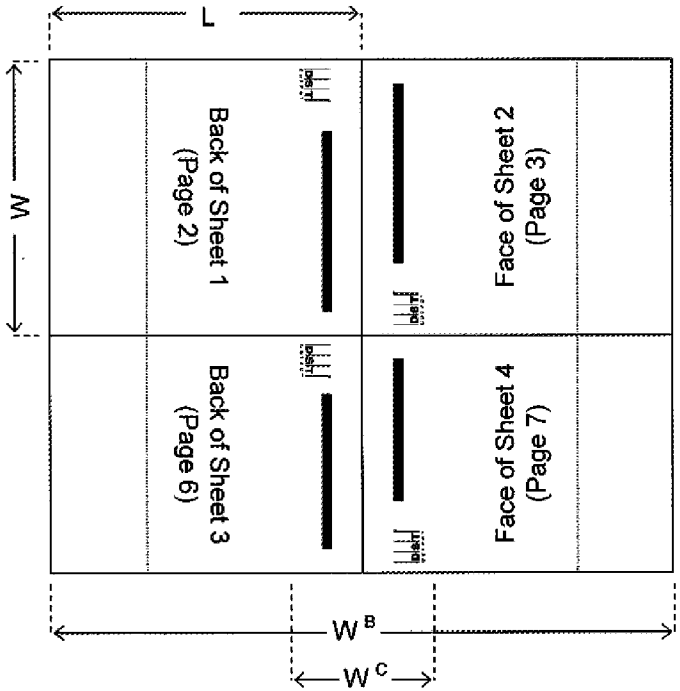
FIG. 4 illustrates the subject invention's formatting technique that produces lazy-portrait documents wherein four total printed sheets are depicted in a duplexed lazy-portrait head-to-head page orientation and printed on a continuous web in two printing lanes (simplexed printing jobs are only printed on one side of a sheet, thereby making assembly of a multi-page document more simplistic than with the duplexed embodiment which requires a sheet flipping process step for one of paired sheets relative to the other sheet that is the main focus of the subject invention).
Figure 7A:
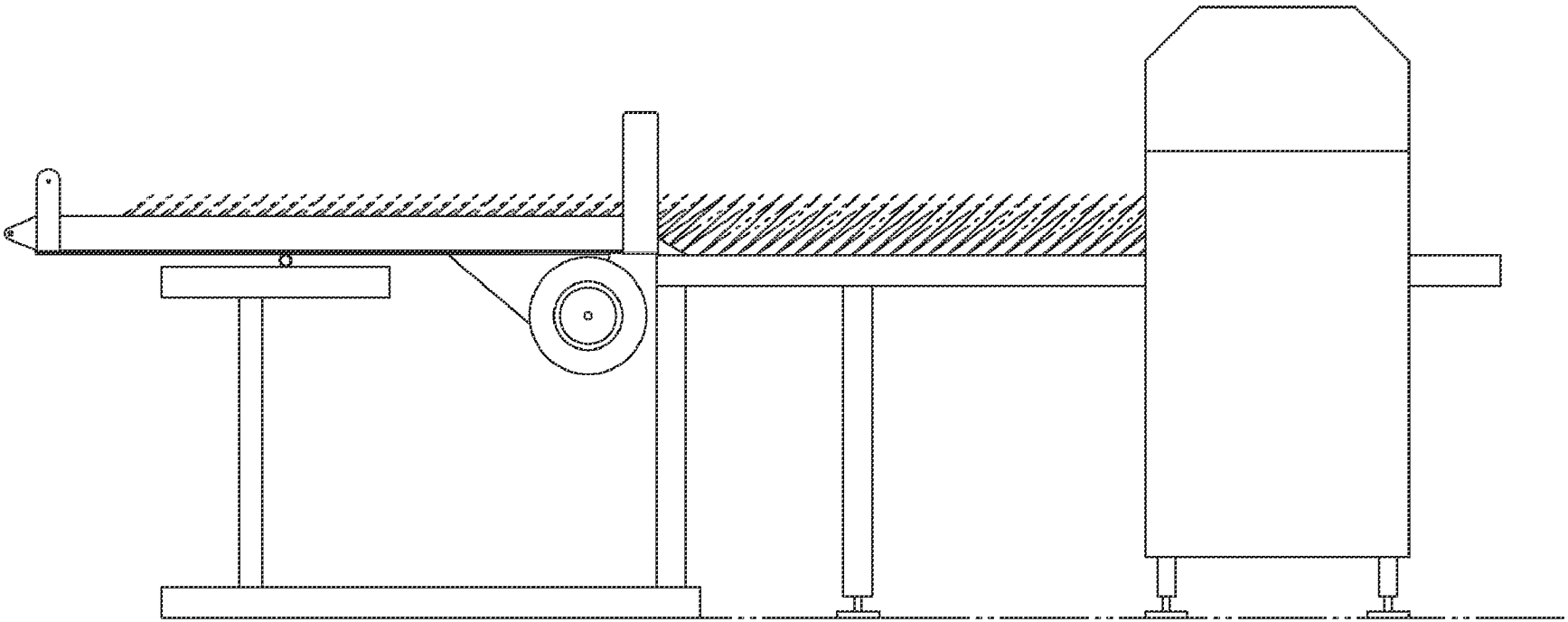
FIG. 7A (Prior Art)
FIG. 7A shows an example of how the PRIOR ART utilized a traditional transfer cart (a standard hand cart or dolly), in a tilted or horizontal position at a receiving station (support rack in front of the printing producing the fan-folded documents) with its removable bottom plate temporarily removed for loading the printed documents as they exit a printer in a fan-folded stream.
Figure 7B:
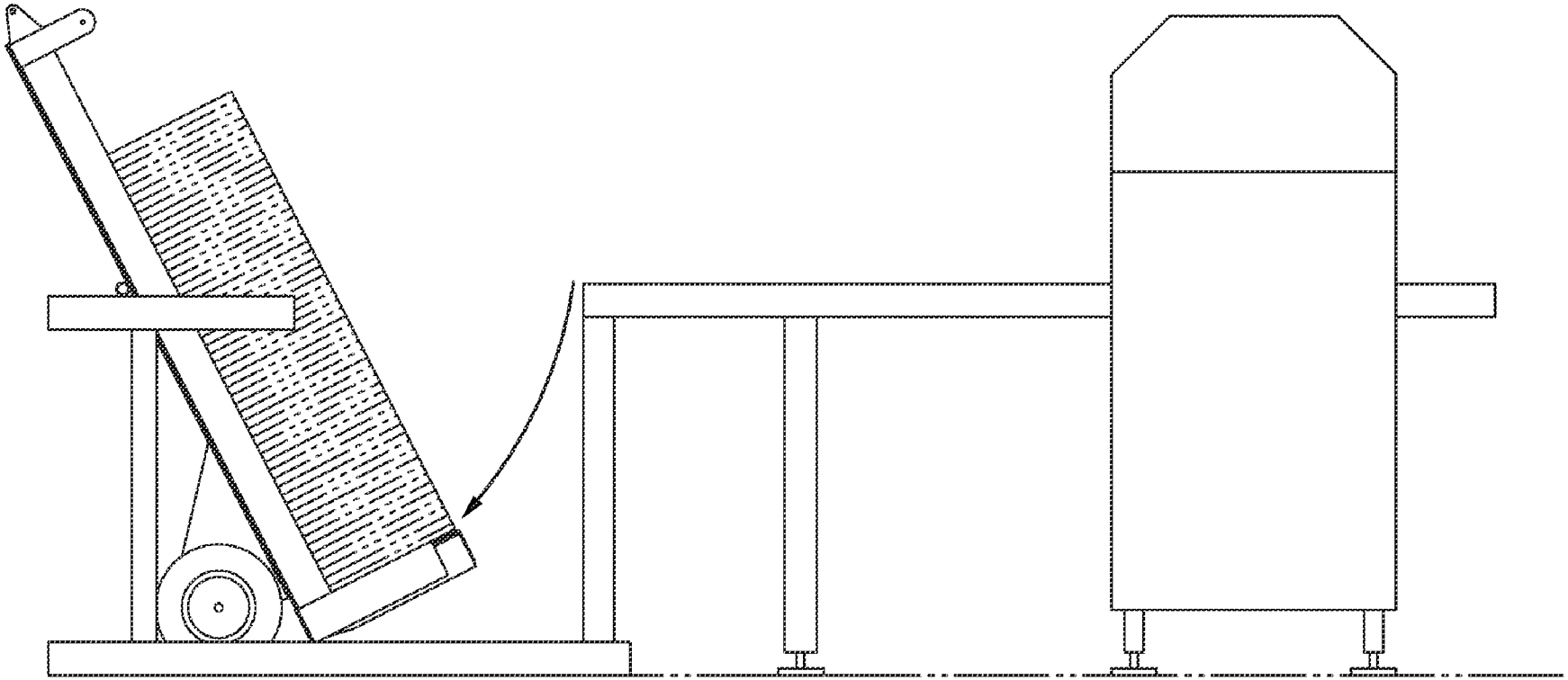
FIG. 7B (Prior Art)
FIG. 7B shows the traditional PRIOR ART transfer cart that has received the fan-folded documents (the removable bottom plate is now replaced into a document-support position) and is now lowered from the receiving horizontal position to contact the transfer cart's wheels with the ground for future movement.
Figure 7C:
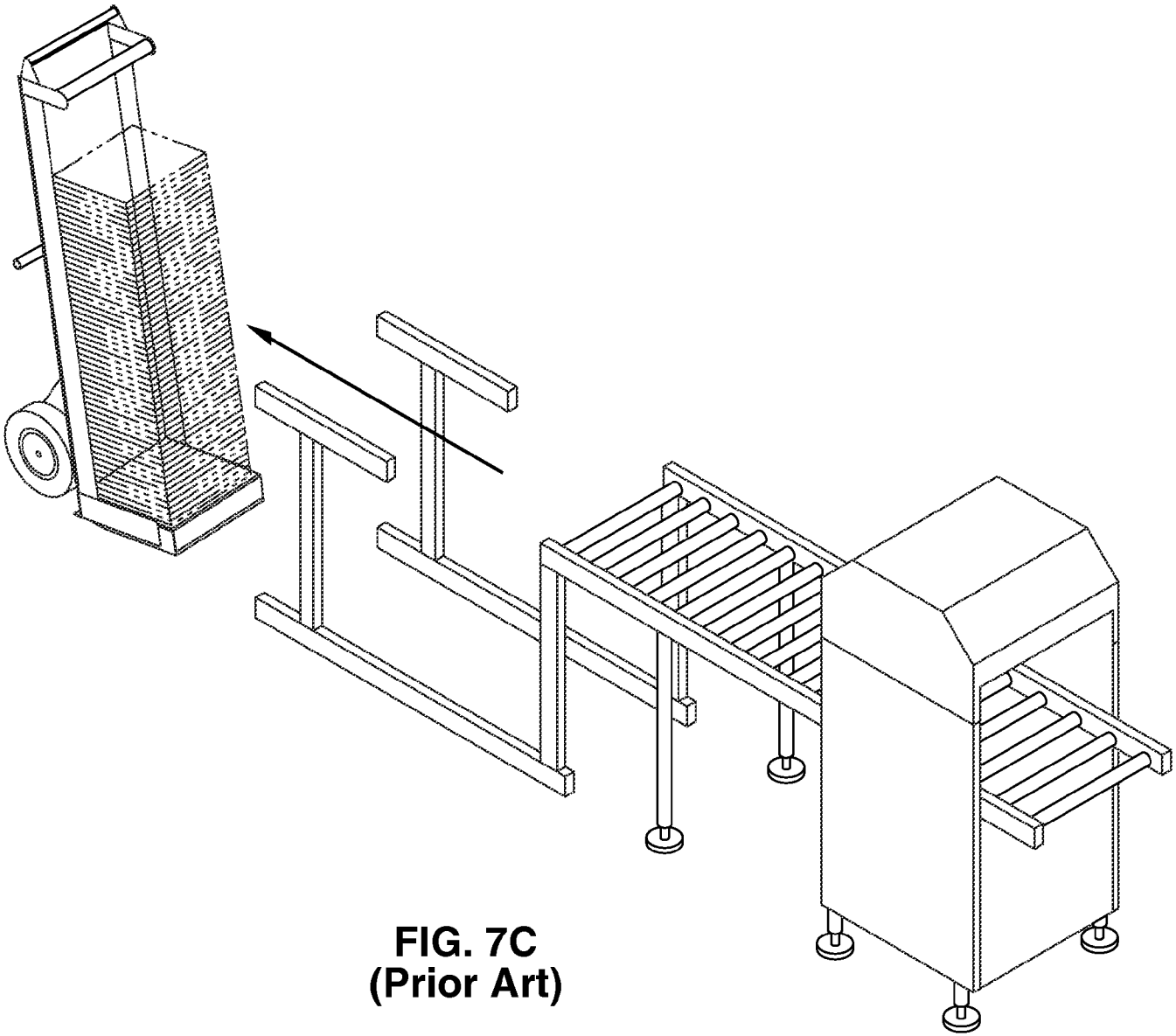
FIG. 7C (Prior Art)
FIG. 7C shows the traditional PRIOR ART transfer cart moving away from its printing station where it received the fan-folded document from the printer.
Figure 8:
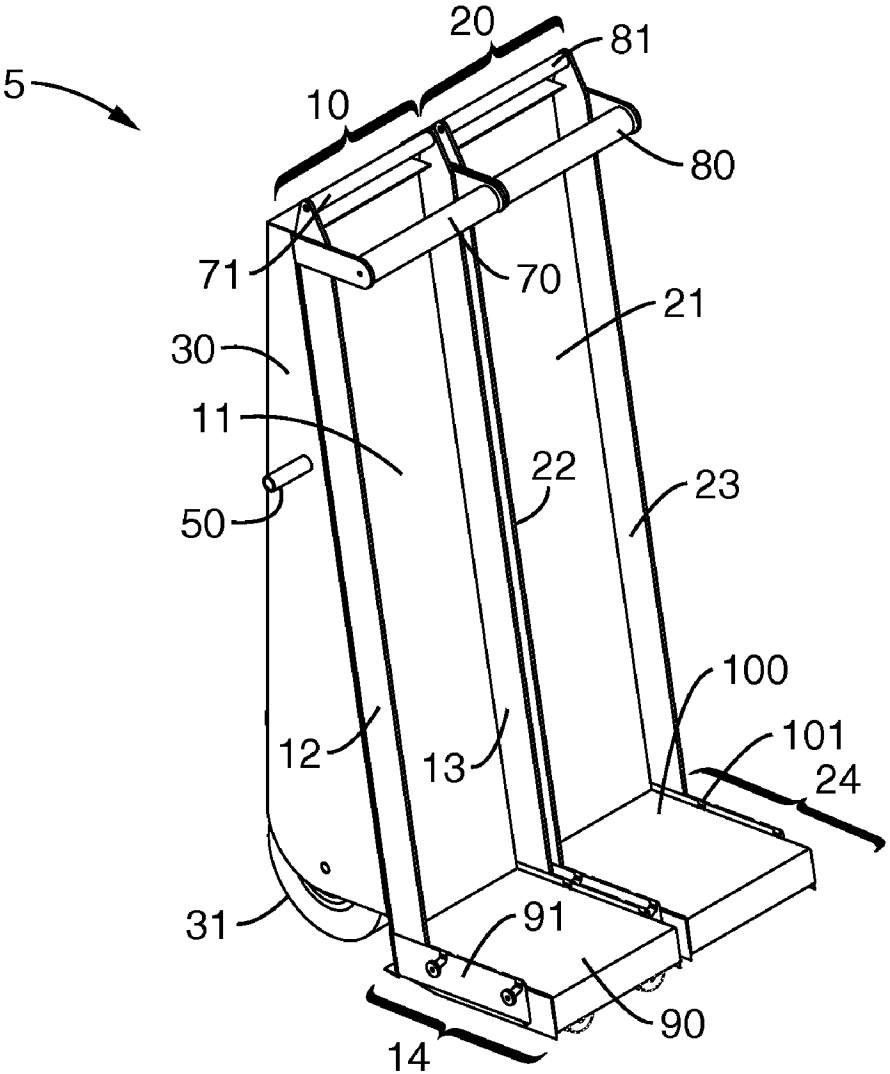
FIG. 8 is a perspective view of the subject invention hinged and bifurcated cart in its closed or document receiving state.
Figure 10:
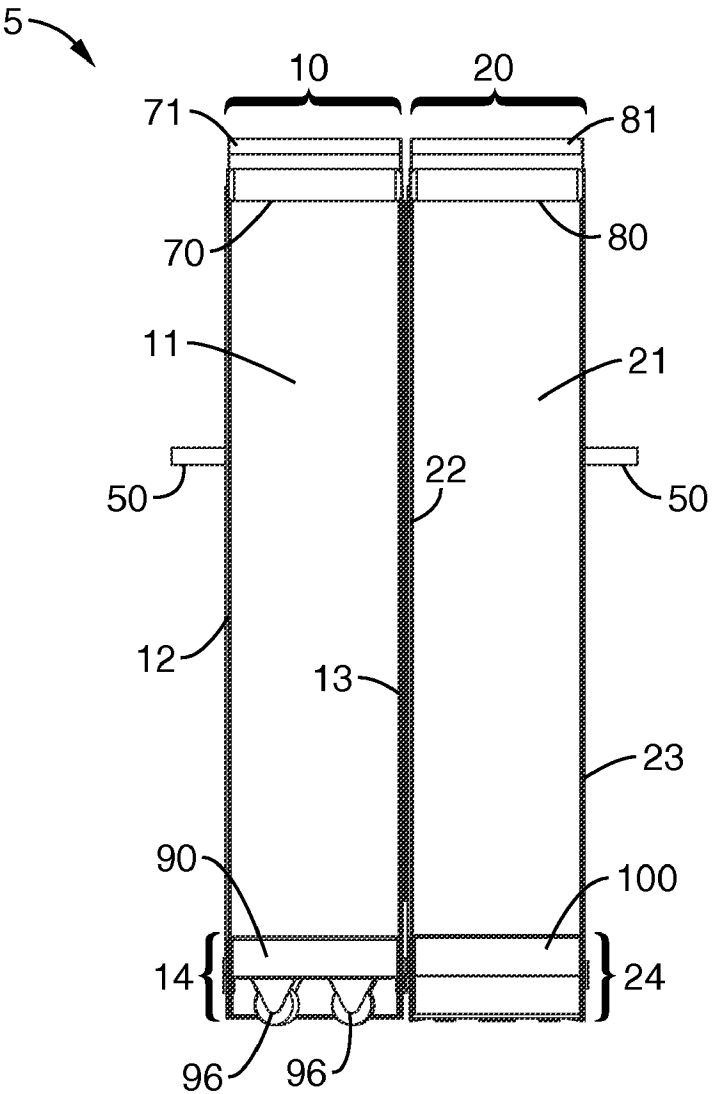
FIG. 10 is a front view of the subject invention hinged and bifurcated cart seen in FIG. 8 in its closed or document receiving state.
Figure 9:
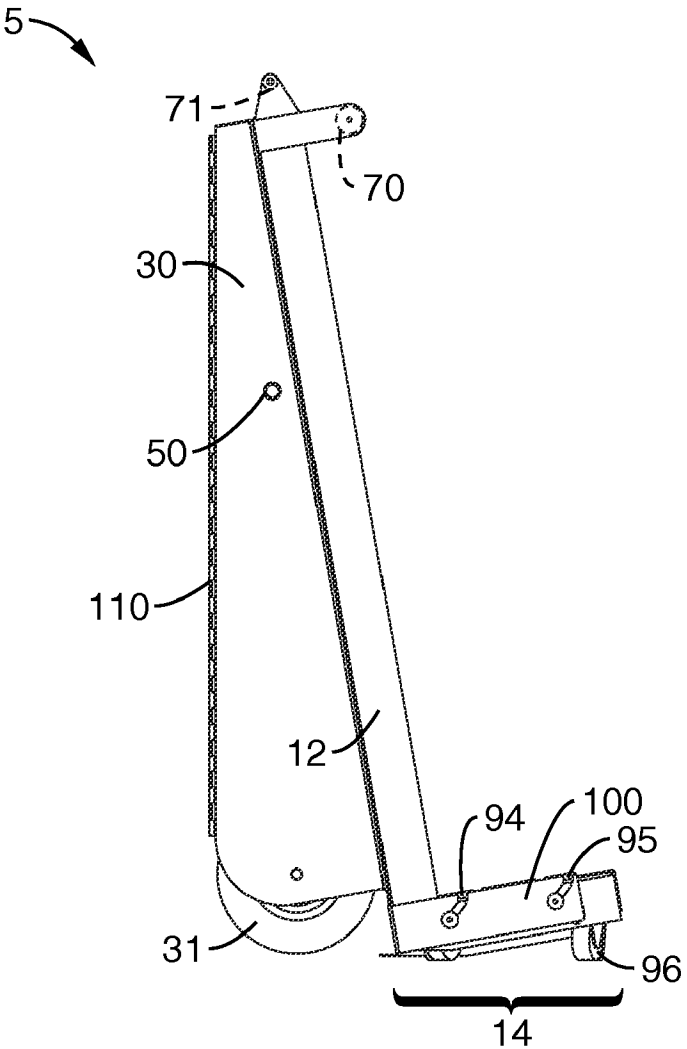
FIG. 9 is a side view of the subject invention hinged and bifurcated cart seen in FIG. 8 in its closed or document receiving state.
Figure 11:
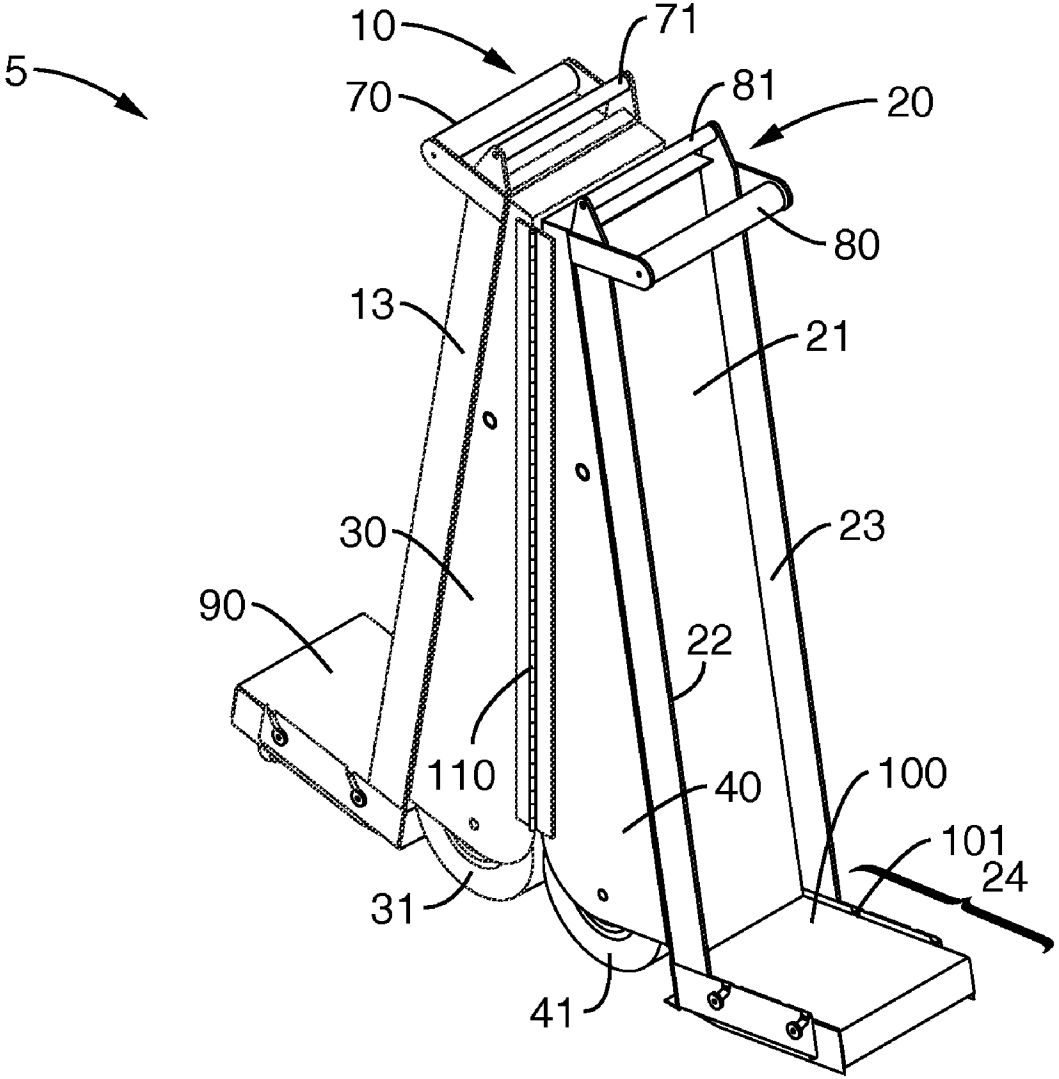
FIG. 11 is a perspective view of the subject invention hinged and bifurcated cart showing the two halves of the cart opened along a central hinge to generate back-to-back document containers (opened or document delivering state of the cart).
Figure 13:
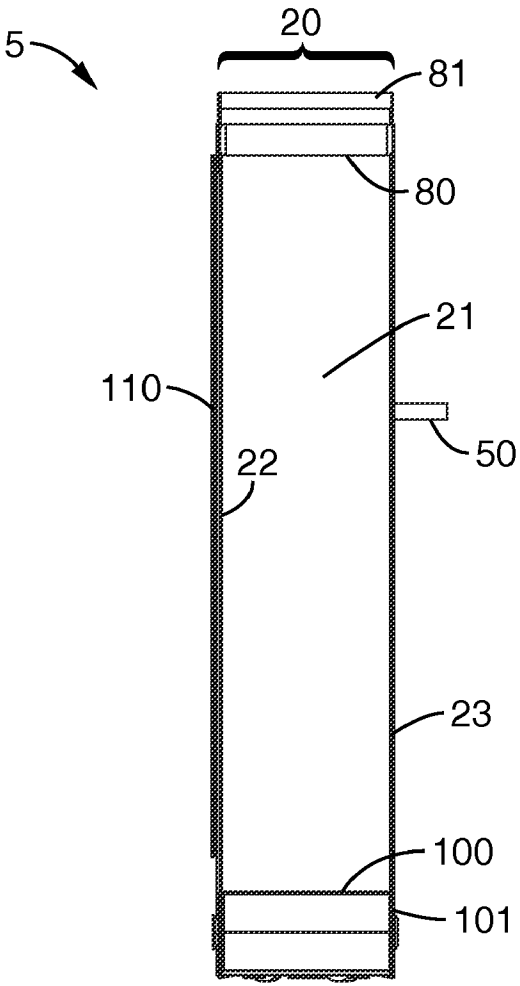
FIG. 13 is a front view of the opened subject invention hinged and bifulcated cart seen in FIG. 11 (opened or document delivering state of the cart).
Figure 12:
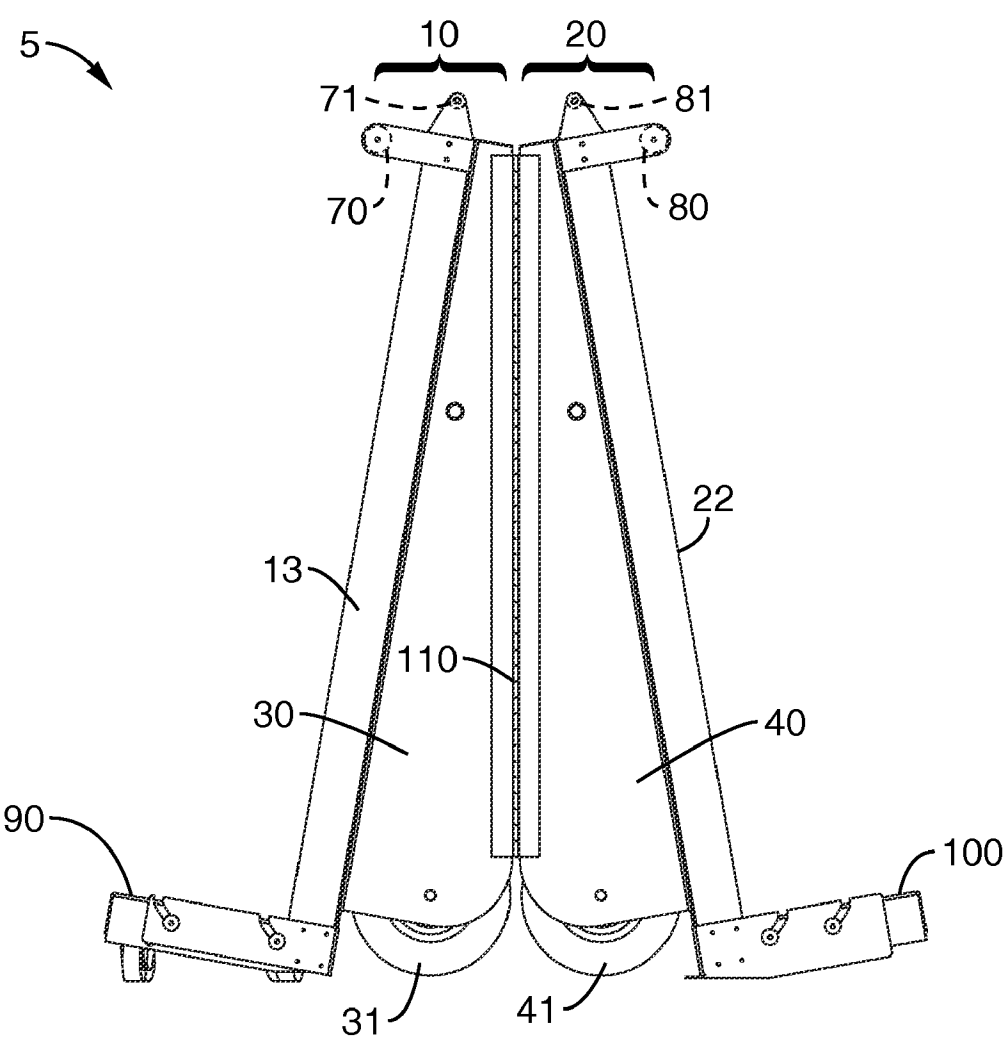
FIG. 12 is a side view of the opened subject invention hinged and bifurcated cart seen in FIG. 11 (opened or document delivering state of the cart).

Specifically, as seen in FIG. 8, the subject bifurcated cart (seen in its closed state to receive documents) has two hinged-to-each-other page-receiving halves or trays 10 and 20 which are designed to function as side-by-side page receiving means when being loaded with the two streams of LPEE printed documents, one stream in each tray 10 and 20 (post slitting that generated the two side-by-side streams of LPEE documents). Each receiving tray 10 and 20 has a back panel 11 and 21, opposing side panels 12, 13, 22, and 23, a bottom support assembly 14 and 24, a back support member 30 and 40, a transport wheel 31 and 41 attached to each back support member 30 and 40, respectively, a cart support rack/frame pivot bar 50 and 60 (for tilting into the document loading position on the supporting rack/frame), a paper path roller 70 and 80, and a cart handle 71 and 81.

The removable bottom support assemblies 14 and 24 usually differ slightly from one another. Assembly 14 comprises a removable bottom support plate 90. The bottom support plate 90 is releasibly mounted on support arms 91 and 92 that project out from the bottom of the tray 10 and held in place by suitable means such as the shown clips 94 (a pair on each side of the bottom support plate 90) and slots 95 (a pair in each arm 91 and 92). The bottom support plate 90 may be removed by simply sliding the plate clips 94 out of the arm slots 95. The bottom plate 90 is remounted by sliding the plate clips 94 back into the arm slots 95. Bottom support assembly 14 has a hinge rotational support means fastened to the lower side of the bottom support plate 90. The rotational support means usually comprises one or more casters/wheels 96 that aids in swiveling one tray 10 from the other tray 20 when the cart 5 is opened along the central hinge 110 to deliver the two separate streams of fan-folded sheets, one stream flipped from the printed orientation.

Bottom support assembly 24 comprises a removable bottom support plate 100. The bottom support plate 100 is releasibly mounted on support arms 101 and 102 that project out from the bottom of the tray 20 and held in place by suitable means such as the shown clips 94 (a pair on each side of the bottom support plate 100) and slots 95 (a pair in each arm 101 and 102). The bottom support plate 100 may be removed by simply sliding the plate clips 94 out of the arm slots 95. The bottom plate 100 is remounted by sliding the plate clips 94 back into the arm slots 95. Normally, the bottom support assembly 24 does not have a hinge rotational support means as seen in bottom support assembly 14 since only one tray 10 needs to rotate away while the other tray 20 remains relatively stationary on the floor (both halves may have hinge rotational support means and this is contemplated to be within the realm of this disclosure).

A central hinge 110 is provided for a pivotal connection between the two trays 10 and 20. When the cart 5 is ready to deliver the two separate fan-folded streams of documents the cart 5 is opened along the central hinge 110 that connects the two trays 10 and 20 to one another. Usually, tray 20 is stationary on the floor while tray 10 rotates away from tray 20, supported by the casters/wheels 96, and into the opened document delivery configuration seen in FIGS. 11-13 and 15. FIGS. 8-19 and 14 all show the subject cart 5 in its closed or document receiving state (FIG. 14 clearly shows the cart 5 pivoted into a horizontal position to receive the incoming two streams of fan-folded documents from the slitter) while FIGS. 11-13 and 15 all show the subject cart 5 in its opened or document delivering state.

Stressing FIG. 15, the beauty of the subject cart 5 is clearly seen. Once the subject cart 5 is loaded with the two separate steams of fan-folded documents that are printed in LPEE formatting, the subject cart is merely moved to any desired location for cutting and collating. Once at the desired location the cart 5 is simply opened into its delivery configuration, the document streams from the two separate document stacks are drawn in the same direction over their delivery rollers 70 and 80 and pulled into the cutter/collator. The 180° opening of the cart 5 flips the one stack's orientation when the sheets are drawn from the same side over rollers 70 and 80.

A suitable control and verification means are associated with the subject method. Those means implement the subject method by generating printed pages from input data, tracking printed pages through the slitter, subject cart flipping process, cutter, and collator, and verifying the process is functioning properly and that correctly page-sequenced document sets are created. Appropriately designed computer programs control the LPEE printing process, necessary paper transport processes, the slitting device, the cutting equipment, the collation of correctly page-sequenced document sets, and any additional post collation processes. Once familiar with the subject invention, such programming abilities are within the skill of those programmers familiar with high-speed printing techniques, requirements, and equipment.

One benefit of the subject invention is that a single paper stack handling cart (bifurcated at a hinged region), with an overall structural similarity (before operation of the hinged movement) to existing stack paper handling carts, utilize similar equipment on the printers, so no additional structural changes or investment are needed on the printers. In addition, the paper path from the subject cart is a smooth path with no tortuous bends, thereby eliminating paper breakage to the cutter. A further benefit of this invention is that this system allows printing LPEE with existing printing and folding equipment and cutting and inserting on an inserter that has been minimally modified to accommodate the LPEE paper sheet and image orientation.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A bifurcated transportation and handling cart for utilization with lazy-portrait narrow-end to narrow-end (LPEE) formatted printed sheets, wherein said cart comprises:

a) side-by-side document receiving trays that are connected to one another by a non-releasable hinging means, wherein said side-by-side document receiving trays transition by rotating 180° about said hinging means into back-to-back document delivery trays for transferring the LPEE formatted printed sheets;

b) cart pivot means secured to each said document receiving tray, wherein said cart pivot means facilitates pivoting the cart between an approximately horizontal sheet receiving orientation and an approximately vertical sheet delivery orientation in which said receiving trays are oriented back-to-back; and c) sheet delivery means secured to each said document receiving trays, wherein said sheet delivery means provides sheet support when transferring the sheets to subsequent processing equipment.

2. A bifurcated transportation and handling cart for utilization with two fan-folded split-streams of LPEE printed sheets, wherein said cart comprises:

a) a pair of receiving trays hinge-mounted to one another, wherein each said receiving tray is configured to hold one fan-folded split-stream of LPEE printed sheets;

b) a pair of back support members, wherein one of said back support members is attached to a rear of each said receiving tray;

c) a pair of bottom support assemblies, wherein one of said bottom support assemblies is attached to a bottom of each said receiving tray; and d) hinge means for connecting said pair of receiving trays to one another via said pair of back support members, wherein when said pair of receiving trays are side-by-side said cart is in a closed configuration ready for receiving and transporting LPEE formatted document stacks and when said pair of receiving trays are rotated 180° from one another along said hinge means and oriented back-to-back said cart is in an open configuration ready for transferring said LPEE formatted document stacks to further processing equipment;

e) cart pivot means secured to each said document receiving trays, wherein said cart pivot means facilitates pivoting the cart between an approximately horizontal sheet receiving orientation and an approximately vertical sheet delivery orientation in which said receiving trays are oriented back-to-back; and f) sheet delivery means secured to each said document receiving tray, wherein said sheet delivery means provides sheet support when transferring the sheets to subsequent processing equipment.

3. A bifurcated transportation and handling cart according to claim 2, wherein said pair of receiving trays comprises:

a) a first tray having opposing top and bottom regions, wherein said first tray is generally rectangular in form and comprised of a first back panel attached to two opposing first side panels and b) a second tray having opposing top and bottom regions, wherein said first tray is generally rectangular in form and comprised of a second back panel attached to two opposing second side panels.

4. A bifurcated transportation and handling cart according to claim 3, wherein said cart pivot means comprises:

a) a first rod attached to and extending perpendicularly out from one of said side panels of said first tray and b) a second rod attached to and extending perpendicularly out from one of said side panels of said second tray, wherein said first and said second rods have an approximately common central axis when said cart is in said closed position with said first and said second trays in side-by-side alignment.

5. A bifurcated transportation and handling cart according to claim 3, wherein said first and said second trays each further comprise handle means associated with said top region of each said tray.

6. A bifurcated transportation and handling cart according to claim 2, wherein said pair of bottom support assemblies comprises:

a) a first bottom support assembly secured to said bottom region of said first tray and comprised of:

i) a first pair of support arms secured to said bottom region of said first tray and projecting perpendicularly away from said first tray;

ii) a removable first bottom support plate detachably secured between first pair of support arms;

iii) at least one hinge rotational support wheel attached to an underside of said first bottom support plate and b) a second bottom support assembly secured to said bottom region of said second tray and comprised of:

i) a second pair of support arms secured to said bottom region of said second tray and projecting perpendicularly away from said second tray; and ii) a removable second bottom support plate detachably secured between second pair of support arms.

7. A bifurcated transportation and handling cart according to claim 2, wherein said hinge means comprises a non-releasable hinge secured between said pair of back support members that allow for said 180° rotational movement.

8. A bifurcated transportation and handling cart according to claim 2, wherein said sheet delivery means comprises;

a) a first document delivery roller mounted proximate said top region of said first tray and b) a second document delivery roller mounted proximate said top region of said second tray.

9. A bifurcated transportation and handling cart according to claim 2, wherein each of said back support members further comprises a transport wheel.

10. A bifurcated transportation and handling cart for utilization with two fan-folded split-streams of LPEE printed sheets, wherein said cart comprises:

a) a pair of receiving trays hinge-mounted to one another, wherein each said receiving tray is configured to hold one fan-folded split-stream of LPEE printed sheets, wherein said pair of receiving trays comprises:

i) a first tray having opposing top and bottom regions, wherein said first tray is generally rectangular in form and comprised of a first back panel attached to two opposing first side panels and ii) a second tray having opposing top and bottom regions, wherein said first tray is generally rectangular in form and comprised of a second back panel attached to two opposing second side panels;

b) a pair of back support members, wherein one of said back support members is attached to a rear of each said receiving tray;

c) a pair of bottom support assemblies, wherein one of said bottom support assemblies is attached to a bottom of each said receiving tray, wherein said pair of bottom support assemblies comprises:

i) a first bottom support assembly secured to said bottom region of said first tray and comprised of:

1) a first pair of support arms secured to said bottom region of said first tray and projecting perpendicularly away from said first tray;

2) a removable first bottom support plate detachably secured between first pair of support arms;

3) at least one hinge rotational support wheel attached to an underside of said first bottom support plate and ii) a second bottom support assembly secured to said bottom region of said second tray and comprised of:

1) a second pair of support arms secured to said bottom region of said second tray and projecting perpendicularly away from said second tray; and 2) a removable second bottom support plate detachably secured between second pair of support arms; ad d) hinge means for connecting said pair of receiving trays to one another via said pair of back support members, wherein when said pair of receiving trays are side-by-side said cart is in a closed configuration ready for receiving and transporting LPEE formatted document stacks and when said pair of receiving trays are rotated 180° from one another along said hinge means and oriented back-to-back said cart is in an open configuration ready for transferring said LPEE formatted document stacks to further processing equipment;

e) cart pivot means secured to each said document receiving tray, wherein said cart pivot means facilitates pivoting the cart between an approximately horizontal sheet receiving orientation and an approximately vertical sheet delivery orientation in which said receiving trays are oriented back-to-back; and f) sheet delivery means secured to each said document receiving tray, wherein said sheet delivery means provides sheet support when transferring the sheets to subsequent processing equipment.

11. A bifurcated transportation and handling cart according to claim 10, wherein said hinge means comprises a non-releasable hinge secured between said pair of back support members that allow for said 180° rotational movement.

12. A bifurcated transportation and handling cart according to claim 10, wherein said sheet delivery means comprises;

a) a first document delivery roller mounted proximate said top region of said first tray and b) a second document delivery roller mounted proximate said top region of said second tray.

13. A bifurcated transportation and handling cart according to claim 10, wherein said cart pivot means comprises:

a) a first rod attached to and extending perpendicularly out from one of said side panels of said first tray and b) a second rod attached to and extending perpendicularly out from one of said side panels of said second tray, wherein said first and said second rods have an approximately common central axis when said cart is in said closed position with said first and said second trays in side-by-side alignment.

14. A bifurcated transportation and handling cart according to claim 10, wherein each of said back support members further comprises a transport wheel.

15. A bifurcated transportation and handling cart according to claim 10, wherein said first and said second trays each further comprise handle means associated with said top region of each said tray, wherein said handle means provides additional sheet support when transferring the sheets to subsequent processing equipment.

16. A bifurcated transportation and handling cart for utilization with two fan-folded split-streams of LPEE printed sheets, wherein said cart comprises:

a) a pair of receiving trays non-releasably hinge-mounted to one another, wherein each said receiving tray is configured to hold one fan-folded split-stream of LPEE printed sheets;

b) a pair of sheet delivery rollers with one said sheet delivery roller mounted to each said receiving tray, wherein said sheet delivery roller provides sheet support when transferring the sheets to subsequent processing equipment;

c) a pair of back support members, wherein one of said back support members is attached to a rear of each said receiving tray;

d) a transport wheel secured to each said back support member;

e) a pair of bottom support assemblies, wherein one of said bottom support assemblies is attached to a bottom of each said receiving tray; and f) non-releasable hinge means for connecting said pair of receiving trays to one another via said pair of back support members, wherein when said pair of receiving trays are side-by-side said cart is in a closed configuration ready for receiving and transporting LPEE formatted document stacks and when said pair of receiving trays are rotated 180° from one another along said hinge means and oriented back-to-back said cart is in an open configuration ready for transferring said LPEE formatted document stacks to further processing equipment; and g) cart pivot means secured to each said document receiving tray, wherein said cart pivot means facilitates pivoting the cart between an approximate horizontal sheet receiving orientation and an approximate vertical sheet delivery orientation in which said receiving trays are oriented back-to-back.

17. A bifurcated transportation and handling cart according to claim 16, wherein said pair of receiving trays comprises:

a) a first tray having opposing top and bottom regions, wherein said first tray is generally rectangular in form and comprised of a first back panel attached to two opposing first side panels and b) a second tray having opposing top and bottom regions, wherein said first tray is generally rectangular in form and comprised of a second back panel attached to two opposing second side panels.

18. A bifurcated transportation and handling cart according to claim 16, wherein said pair of bottom support assemblies comprises:

a) a first bottom support assembly secured to said bottom region of said first tray and comprised of:

i) a first pair of support arms secured to said bottom region of said first tray and projecting perpendicularly away from said first tray;

ii) a removable first bottom support plate detachably secured between first pair of support arms;

iii) at least one hinge rotational support wheel attached to an underside of said first bottom support plate and b) a second bottom support assembly secured to said bottom region of said second tray and comprised of:

i) a second pair of support arms secured to said bottom region of said second tray and projecting perpendicularly away from said second tray; and ii) a removable second bottom support plate detachably secured between second pair of support arms.

19. A bifurcated transportation and handling cart according to claim 16, wherein said cart pivot means comprises:

a) a first rod attached to and extending perpendicularly out from one of said side panels of said first tray and b) a second rod attached to and extending perpendicularly out from one of said side panels of said second tray, wherein said first and said second rods have an approximately common central axis when said cart is in said closed position with said first and said second trays in side-by-side alignment.

20. A bifurcated transportation and handling cart according to claim 16, wherein said first and said second trays each further comprise handle means associated with said top region of each said tray, wherein said handle means provide additional sheet support when transferring the sheets to subsequent processing equipment.

* * * * *